US007856713B2

(12) United States Patent
Suzuki et al.

(10) Patent No.: US 7,856,713 B2
(45) Date of Patent: Dec. 28, 2010

(54) METHOD FOR MANUFACTURING COMBINED TERMINALS

(75) Inventors: Shinobu Suzuki, Shizuoka-ken (JP); Kouichi Ohyama, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 6 days.

(21) Appl. No.: 12/330,048

(22) Filed: Dec. 8, 2008

(65) Prior Publication Data

US 2009/0144976 A1 Jun. 11, 2009

(30) Foreign Application Priority Data

Dec. 10, 2007 (JP) ..... P2007-318060

(51) Int. Cl.
*H01R 43/00* (2006.01)

(52) U.S. Cl. ..... 29/884; 29/827; 29/882; 29/874; 29/876; 439/885; 439/830; 439/397; 439/497; 361/800

(58) Field of Classification Search ..... 29/827, 29/884, 882, 876, 874; 439/621, 830, 885, 439/397, 399, 497; 361/800
See application file for complete search history.

(56) References Cited

U.S. PATENT DOCUMENTS 4,158,745 A * 6/1979 Keller ..... 174/536
4,633,582 A * 1/1987 Ching et al. ..... 29/827
6,155,857 A * 12/2000 Kato et al. ..... 439/248

FOREIGN PATENT DOCUMENTS

JP 8-213145 8/1996
JP 2002-260806 9/2002

* cited by examiner

*Primary Examiner*—Derris H Banks
*Assistant Examiner*—Jeffrey Carley
(74) *Attorney, Agent, or Firm*—Finnegan, Henderson, Farabow, Garrett & Dunner, L.L.P.

(57) ABSTRACT

A combined terminal is made by combination of first and second terminals. The first terminal has a first plate portion. The second terminal has a second plate portion and a window portion formed in the second plate portion. The first and second terminals are combined so that the first and second plate portions are superposed while the first terminal remains to be linked to a frame by a link portion therebetween. The combined first and second terminals are removed from the frame by cutting the link portion through the window portion.

4 Claims, 5 Drawing Sheets

METHOD FOR MANUFACTURING COMBINED TERMINALS

CROSS REFERENCE TO RELATED APPLICATION

This application is based upon and claims the benefit of priority from Japanese Patent Application No. 2007-318060 filed on Dec. 10, 2007, the entire contents of which are incorporated herein by reference.

BACKGROUND OF THE INVENTION

1. Field of the Invention

The present invention relates to a method for manufacturing a combined terminal formed by combination of female and male terminals that are separately made.

2. Description of the Related Art

Conventional terminals are known from Japanese Patent Application Laid-Open Publication Nos. 2002-260806 and 08-213145.

Generally, these terminals to be accommodated into a connector housing are often manufactured in chains with a frame (carry) so that the terminals remain to be connected with the frame by link portions, and each terminal is cut off from the frame when used. This is because the frame with the terminals is rolled and a large amount of the terminals can be supplied to various working machines.

In terminals being accommodated into a connector or the like for an electrical connection, there is a combined terminal mechanically integrated by female and male terminals that are individually manufactured from plates with different thicknesses.

SUMMARY OF THE INVENTION

Hereinafter, an art concerning the present invention is briefly explained.

FIG. 1 is a perspective view showing a configuration of a female terminal which is a component of a combined terminal according to the art. FIG. 2 is a perspective view showing processes to crimp the female terminal into a male terminal for integration. FIG. 3 is a perspective view showing the combined terminal configured by crimping the female terminal into the male terminal.

As shown in FIG. 1, the female terminal 10 has: a tubular electric contact portion 11 formed in the tip-end side thereof; a plate portion 12 formed in the base side thereof; a pair of crimping pieces 13, 13 formed so as to stand from the left and right edges of the plate portion 12; and two through holes 15 (see FIG. 7) formed in the plate portion 12. The female terminals 10 are manufactured on a line so that each of them is arranged in respective openings 18*a* of a frame (carry) 18. Each female terminal 10 is linked to the frame 18 by a link portion 14.

On the other hand, as shown in FIG. 2, the male terminal 120 has: a plate portion 121 including a crimped portion 121*a* in the base portion thereof; two pin terminals 122 provided in the tip-end thereof, the two pin terminals being parallel to each other and extending from the plate portion 121; two projection portions 125 projecting to a back side of the plate portion 121, the back side being the opposite side to the front side seen in the figure; and first and second positioning projections 126, 127 provided in the left and right edges of the plate portion 121. The male terminals 120 are manufactured on a line with a frame 128. The pin terminals 122 are arranged in respective openings 128*a* of the frame 128 and each of the male terminals 120 is linked to the frame 128 by a link portion 124 continuously formed from the second positioning projections 127.

When the combined terminal 101 of FIG. 3 is manufactured, the female terminal 10 is removed from the frame 18 by cutting off the link portion 14.

Next, as shown in FIG. 2, the female terminal 10 is set to the plate portion 121 of the male terminal 120 which is held by the frame 128. Specifically, the plate portion 12 of the female terminal 10 is arranged onto the lower side of the plate portion 121 of the male terminal 120 so that the crimped portion 121*a* of the male terminal 120 positions between the pair of the crimping pieces 13, 13 of the female terminal 10. In this case, the first positioning projection 126 properly positions the plate portions 12 and 121, and the projection portion 125 of the male terminal 120 is inserted into the through hole 15 (see FIG. 7) of the female terminal 10.

Thereafter the pair of the crimping pieces 13, 13 is inwardly bent onto the crimped portion 121*a* and the crimped portion 121*a* is crimped. After or before crimping as described above, by pressing (hammering) the male terminal 120, an expanded portion (not shown) is formed in the tip-end of the projection portion 125 already inserted in the through hole 15. Accordingly, the expanded portion and the plate portion 120 fasten the plate portion 12 of the female terminal 10 by sandwich manner.

From processes as described above, the male terminal 120 and female terminal 10 can be combined securely. They are removed from the frame 128 by cutting the link portion 124 after combining. Consequently, the combined terminal 101, which has an integral structure of the male terminal 120 and the female terminal 10, is obtained.

According to the method depicted by FIGS. 1 to 3, the female terminal 10 is removed from the frame 18 in advance and is supplied individually. Thereafter, both terminals 10, 120 are combined while the male terminal 120 links to the frame 128.

However, depending on a structure of the male terminal, the male terminal cannot be supplied in a state where it links to the frame. In this case, although it is presumed that the male terminal is separately supplied and the male and female terminals are combined piece by piece, positioning accuracies thereof while combining them cannot be secured, further, number of processes will increase due to combining them piece by piece.

With taking into consideration the above circumstances, the present invention is objected to provide a method for manufacturing a combined terminal, which can easily combine two terminals with securing positioning accuracies thereof and can prevent number of processes to increase.

An aspect of the present invention is a method for manufacturing a combined terminal, the method comprises the steps of: making a plurality of first terminals with a frame, the first terminals being arranged on a line on the frame, each of the first terminals having a first plate portion linked to the frame by a link portion provided between the first plate portion and the frame; making second terminals separately having a second plate portion and a window portion provided in the second plate portion; fixing the second plate portion on the first plate portion; and thereafter removing each of the first terminals from the frame by cutting the link portion through the window portion in the second plate portion, thereby forming the combined terminal.

The first and second terminals may be a female terminal and male terminal, respectively; and the first and second plate portions may be fixed to each other so that tip-ends thereof mutually face to opposite directions.

One of the first and second plate portions may have crimping pieces in both edges thereof; and the first and second plate portions may be fixed to each other by bending and crimping the crimping pieces to the other of the first or second plate portions.

One of the first and second plate portions may have a projection portion and the other thereof may have a through hole. In fixing the first and second plate portions to each other, the projection portion may be inserted into the through hole and a top thereof may be pressed to form an expanded portion so that the expanded portion and the one of the first and second plate portions sandwich the other of the first and second plate portions.

DESCRIPTION OF THE EMBODIMENT

An embodiment of the present invention is explained hereinafter with reference to drawings.

Figure 1:
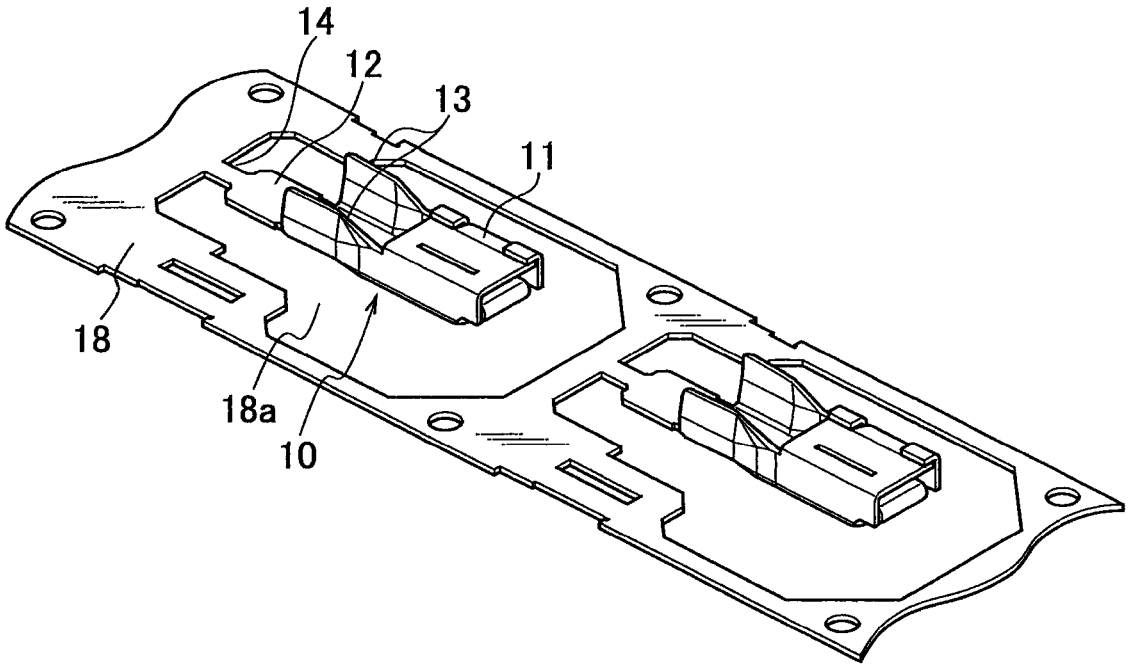
FIG. 1 is a perspective view showing configuration of a female terminal according to a related art.
Figure 2:
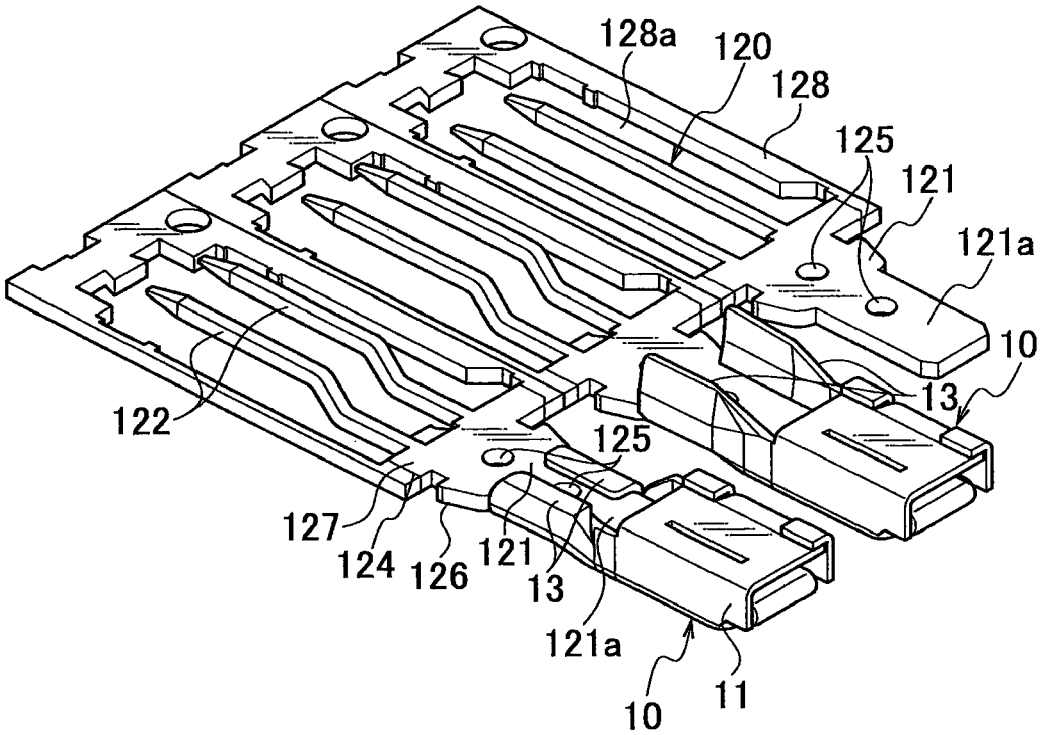
FIG. 2 is a perspective view showing processes to set the female terminal of FIG. 1 to a male terminal according to the related art.
Figure 3:
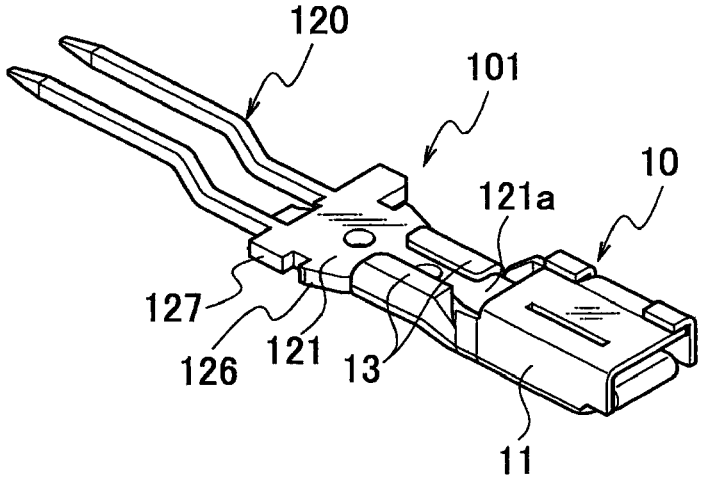
FIG. 3 is a perspective view showing a completed combined terminal according to the related art.

A female terminal (first terminal) 10 according to an embodiment of the present invention has same configuration as shown in FIG. 1. As indicated by stage A of FIGS. 6 and 7, the female terminal 10 has: a tubular electric contact portion 11 formed in the tip-end side thereof; a plate portion 12 formed in the base side thereof; a pair of crimping pieces 13, 13 formed so as to stand from the left and right edges of the plate portion 12; and two through holes 15 (see FIG. 7) formed in the plate portion 12. The female terminals 10 are manufactured on a line so that each of them is arranged in respective openings 18*a* of a frame (carry) 18. Each female terminal 10 is linked to the frame 18 by a link portion 14.

Figure 6:
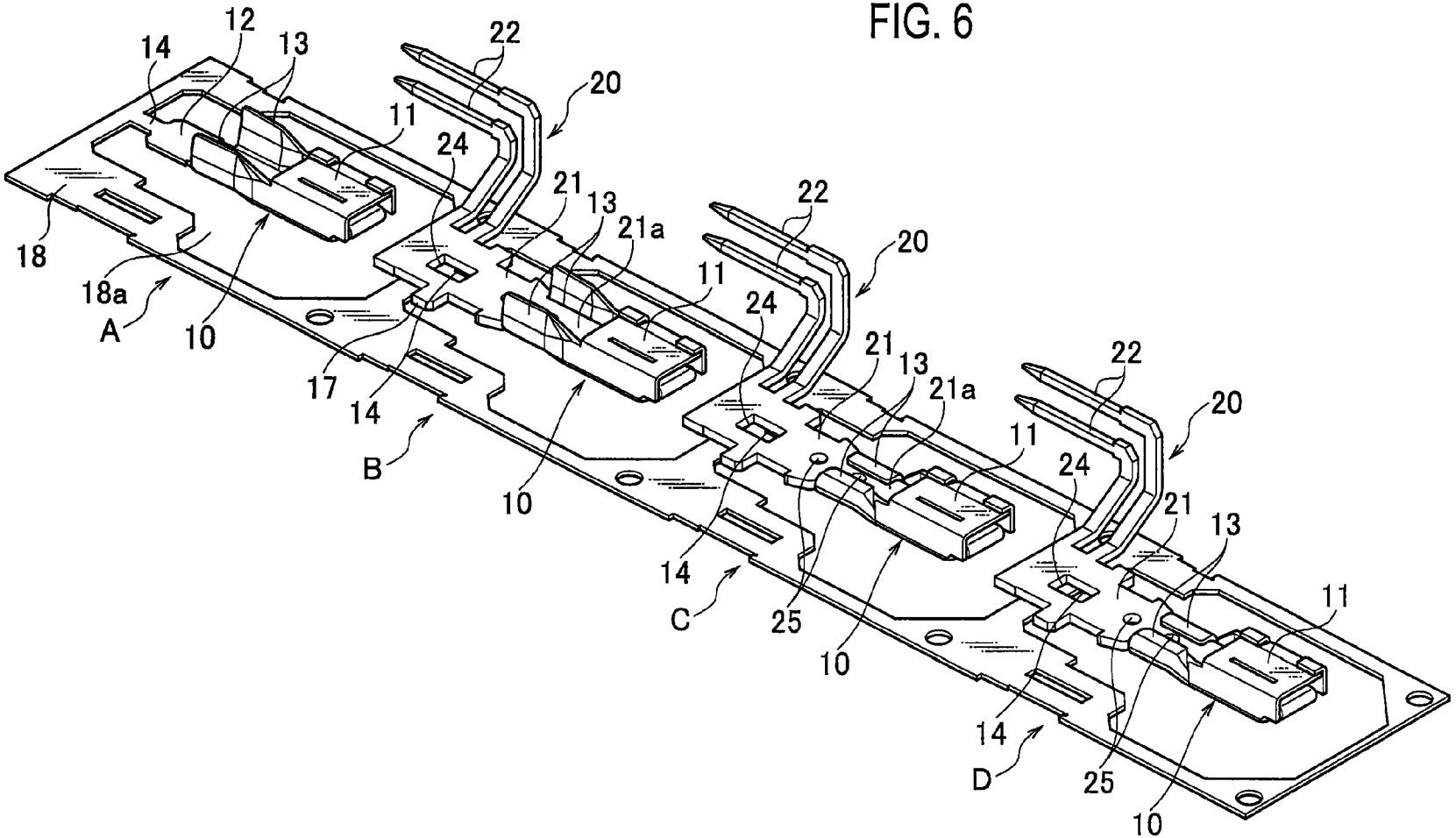
FIG. 6 is a perspective view showing a series of processes from combining to cutting off according to the embodiment of the present invention.
Figure 7:
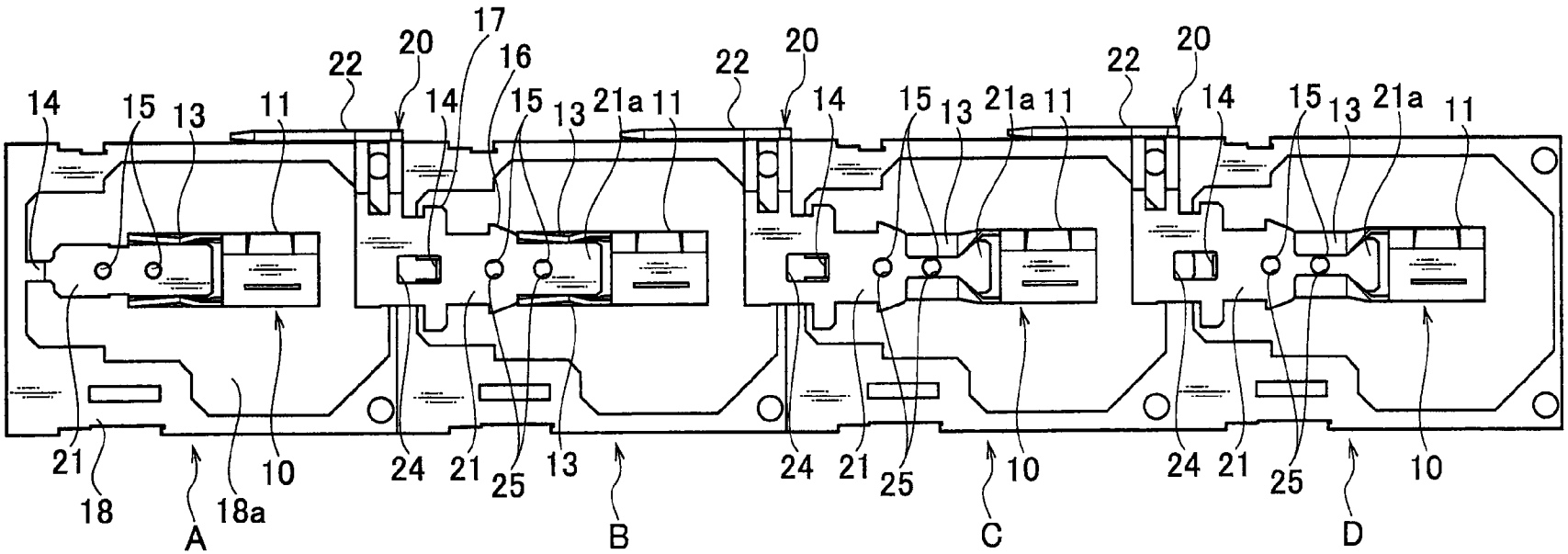
FIG. 7 is a plan view of FIG. 6.

On the other hand, a male terminal (second terminal) 20 has: a plate portion 21 including crimped portion 21*a* in the base portion thereof; two pin terminals 22 provided so as to stand obliquely from one side of the tip-end side in the plate portion 21, each of the pin terminals 22 being formed in L-shape and being parallel to each other; two projection portions 25 projecting to a back side of the plate portion 25, the back side being the opposite side to the front side as seen in FIGS. 6 and 7; and first and second positioning projections 16, 17 provided in the left and right edges of the plate portion 21. The male terminal 20 is separately and independently formed.

When a combined terminal 1 according to the embodiment is manufactured, firstly, the female terminals 10 are prepared in a state where they are linked to a frame 18 and arranged on a line thereon. The male terminals 20 are separately prepared.

Next, as indicated by stage B of FIGS. 6 and 7, the plate portion 21 of the male terminal 20 is put on the plate portion 12 of the female terminal 10. Here, the female terminal 10 remains to be fixed to the frame 18. Specifically, the male terminal 20 is set to female terminal 10 so that the plate portion 21 of the male terminal 20 is superposed on the plate portion 12 of the female terminal 10, and the crimped portion 21*a* is positioned between the pair of crimping pieces 13, 13. In this case, the female and male terminals 10, 20 are arranged so that the electric contact portion 11 and the pin terminals 22, which are respectively located in their tip-end sides, are mutually faced into opposite directions. Further, in this case, positions of the plate portions 12 and 21 are fitted each other by the first positioning projection portion 16, and the projection portion 25 of the male terminal 20 is inserted into the through hole 15 (see FIG. 7) of the female terminal 10.

Next, as indicated by stage C of FIGS. 6 and 7, the pair of crimping pieces 13, 13 are inwardly bent onto the crimped portion 21*a*, and by pressing (hammering) the male terminal 20, an expanded portion (not shown) is formed in the tip-end of the projection portion 25 already inserted in the through hole 15. Accordingly, the expanded portion and the plate portion 21 fasten the plate portion 12 of the female terminal 10 by sandwich manner. Therefore, the male terminal 20 and female terminal 10 can be combined securely.

Figure 4:
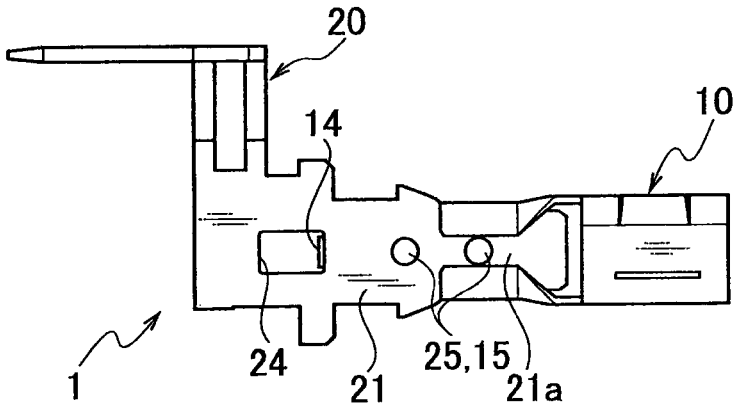
FIG. 4 is a plan view showing a configuration of a combined terminal by a method according to an embodiment of the present invention.
Figure 5:
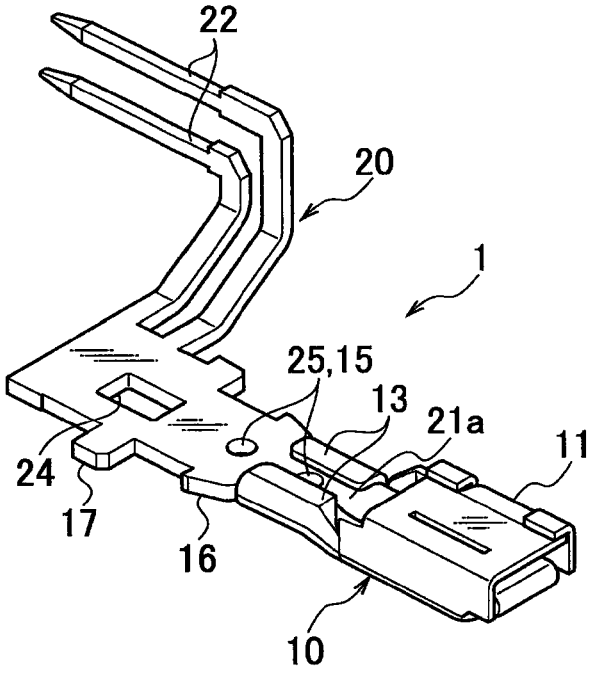
FIG. 5 is a perspective view showing the combined terminal of FIG. 4.

Next, as indicated by stage D of FIGS. 6 and 7, the female terminal 10 is removed from the frame 18 by cutting the link portion 14 through a window 24 formed in the plate portion 21 of the male terminal 20. Consequently, the combined terminal 1 as shown in FIG. 4 is obtained.

As described above, according to the method of the embodiment, the female terminal 10 is combined to the male terminal 20 while the female terminal 10 remains to be linked to the frame 18. Therefore, the terminals 10, 20 are positioned easily and accurately. Since the link portion 14, which links the female terminal 10 and the frame 18, is cut through the window 24 formed in the plate portion 21 of the male terminal 20, burr or the like cause by cutting can be hardly viewable from the outside.

If the link portion 14 is located in an area where the female and male terminals 10, 20 are not superposed each other, the link portion 14 can also be cut after the male terminal 20 is fitted to the female terminal 10 while the female terminal 10 remains to be linked to the frame 18. In this case, however, a burr or the like caused by cutting may unexpectedly project from an outer circumference of the combined terminal. Therefore, the burr may interfere with accommodation of the combined terminal into a connector housing. On the other hand, in the embodiment of the present invention, it is possible to prevent the burr from projecting from the outer circumference by cutting the link portion 14 through the window 24 provided in the plate portion 21 of the male terminal 20. Therefore, even if the burr exists, it is not disturbance to accommodate the combined terminal 1 into the connector housing or the like. In this embodiment, the female and male terminals 10, 20 are not combined in a state where they are individually separated, thus it is possible to suppress increase of the number of processes.

According to the embodiment, the female and male terminal 10, 20 are combined so as to face their tip-end side (i.e. the electric contact portion 11 and the pin terminal 22) to opposite direction each other. Therefore, if the combined terminal 1 is set in a connector housing, it is possible to configure both female and male connectors that are located in opposite sides each other.

In the embodiment, the plate portions 12, 21 are fitted to each other by crimping (crimping with curling manner) the pair of crimping pieces 13, 13. Therefore, they are securely and integrally combined without loose or rattle. In addition, since the plate portions 12, 21 are securely fitted to each other by pressing the projection portion 25 into the through hole 15, it is possible to integrally combine the female and male terminals 10, 20 without displacement and variation of the resistance thereof.

What is claimed is:

1. A method for manufacturing a combined terminal, the method comprising the steps of:

making a plurality of first terminals with a frame, the first terminals being arranged on a line on the frame, each of the first terminals having a first plate portion linked to the frame by a link portion provided between the first plate portion and the frame;

making a plurality of second terminals having a second plate portion and a window portion provided in the second plate portion;

fixing the second plate portion on the first plate portion; and removing each of the first terminals from the frame by cutting the link portion through the window portion in the second plate portion and forming the combined terminal.

2. The method according to claim 1, wherein the first and second terminals are female terminals and male terminals, respectively, and the first and second plate portions are fixed to each other so that tip-ends thereof mutually face opposite directions.

3. The method according to claim 1, wherein one of the first and second plate portions has crimping pieces in both edges thereof, and the first and second plate portions are fixed to each other by bending and crimping the crimping pieces to the other of the first or second plate portions.

4. The method according to claim 1, wherein one of the first and second plate portions has a projection portion and the other thereof has a through hole, in fixing the first and second plate portions to each other, the projection portion is inserted into the through hole.

* * * * *